US005947017A

United States Patent [19]

Hartwich et al.

[11] Patent Number: 5,947,017

[45] Date of Patent: Sep. 7, 1999

[54] CALENDER HAVING AN END ROLL ASSOCIATED WITH A SUPPLEMENTARY ROLL

[75] Inventors: Gerhard Hartwich; Peter Dornfeld, both of Krefeld, Germany

[73] Assignee: Voith Sulzer Finishing GmbH, Krefeld, Germany

[21] Appl. No.: 08/902,255

[22] Filed: Jul. 29, 1997

[30] Foreign Application Priority Data

Aug. 1, 1996 [DE] Germany ..... 196 31 056

[51] Int. Cl.[6] ..... D21G 1/00; B30B 3/04

[52] U.S. Cl. ..... 100/163 A; 100/162 B; 100/170

[58] Field of Search ..... 100/47, 161, 162 R, 100/163 R, 163 A, 164, 165, 166, 162 B, 170

[56] References Cited

U.S. PATENT DOCUMENTS

| | | | |
|---|---|---|---|
| 3,997,952 | 12/1976 | Lehmann et al. . | |
| 4,198,905 | 4/1980 | Lehmann | 100/162 B |
| 4,366,752 | 1/1983 | Koski . | |
| 4,823,690 | 4/1989 | Stotz | 100/163 A |
| 4,960,046 | 10/1990 | Anstötz | 100/162 B |
| 5,263,840 | 11/1993 | Heitmann | 100/170 |
| 5,590,593 | 1/1997 | Korhonen et al. . | |
| 5,662,037 | 9/1997 | Van Haag | 100/162 B |

FOREIGN PATENT DOCUMENTS

| | | | |
|---|---|---|---|
| 1035177 | 7/1978 | Canada . | |
| 0661405 | 7/1995 | European Pat. Off. . | |
| 3119677 | 1/1982 | Germany . | |
| 4203497 | 8/1993 | Germany . | |
| 7502294 | 8/1976 | Netherlands | 100/162 R |
| 1484112 | 8/1977 | United Kingdom . | |

*Primary Examiner*—Stephen F. Gerrity
*Attorney, Agent, or Firm*—Greenblum & Bernstein, P.L.C.

[57] ABSTRACT

A calender includes a roll stack that has two end rolls and at least one intermediary roll, wherein the end rolls each have a deflection compensation device that acts in the direction of the intermediary roll. At least one end roll has an additional deflection compensation device that acts in the direction away from the intermediary roll. On the side of the at least one end roll which is remote from the intermediary roll is disposed a supplementary roll. This calender is able to carry out a matte satination operation without being fixed as to roll-specific pressures, which pressures must be of a precise magnitude so as to compensate for the deflection of the intermediary rolls.

21 Claims, 2 Drawing Sheets

CALENDER HAVING AN END ROLL ASSOCIATED WITH A SUPPLEMENTARY ROLL

CROSS-REFERENCE OF RELATED APPLICATION

The present invention claims the priority under 35 U.S.C. §119 of German Patent Application No. 196 31 056.3 filed on Aug. 1, 1996, the disclosure of which is expressly incorporated by reference herein in its entirety.

BACKGROUND OF THE INVENTION

1. Field of the Invention

The present invention relates to a calender with a roll stack that has two end rolls and at least one intermediary roll, wherein the end rolls each have a deflection compensation device that acts in the direction of the intermediary roll.

2. Discussion of Background Information

In the current state of the art, calenders are frequently embodied as supercalenders. Supercalenders have a large number of rolls, as a rule 10 or 12, that are disposed vertically one above another. The end rolls are disposed in the highest and lowest positions. The end rolls may also be called the top roll and the bottom roll, respectively.

Calenders of this kind are used, for example, for satinating a paper web, i.e., the paper web is conducted through the nips between neighboring rolls. Through suitable means, the rolls are placed against one another with pressure. This treatment on the one hand compresses the paper web and on the other, gives it an improved surface quality, e.g., higher gloss or better smoothness. The pressing can take place in either of two ways: in the first, one of the two end rolls rotates at a fixed location and the other roll is pressed by a pressing means, e.g., a hydraulic cylinder, in the direction of the fixed end roll; in the second, the top roll and the bottom roll have pressing means that act in opposite directions. The deflections thus produced can be compensated for by deflection compensation devices so that all nips assume a straight course.

At this point, paper manufacturers often like to carry out a matte satination. The process of matte satination may be carried out by a soft calender. Soft calenders, however, are often not available as a result of cost or space requirements, so that the supercalender has to additionally take care of this function.

To carry out matte satination in conventional supercalenders, one of the rolls that is supported in vertically movable supports is fastened in its position in the roll stack using a suitable mechanical locking means. As a rule, the roll fastened in its position is one of the intermediary rolls. All the vertically movable rolls disposed beneath it, including the bottom roll, which is embodied as a deflection compensation roll, are pressed upward against the locked roller by means of a hydraulic cylinder. The deflection of the rolls is in turn compensated for by a deflection compensation device of the bottom roll.

This process has some disadvantages. Frequently, the roll disposed directly above the bottom roll cannot be locked so that a number of rolls, which do not contribute directly to the satination process, have to be driven and correspondingly undergo wear and tear. More importantly, the satination pressure is not adjustable as a practical matter. The satination pressure can only be so great that the deflection of the individual rolls is corrected. In other words, the pressing force of the currently functioning rolls can only be as great as is permitted by the compensation of the individual load deflection of the locked center roll. The pressing force is therefore determined by the weight, the width, and the rigidity of the locked center roll. The pressing force in the working nip cannot be changed because this would lead to an asymmetry of the pressure on the roll width and result in a distortion of the rolled material. If the pressure is too great, the locked roll deflects upward. However, if the pressure is too small, then the locked roll deflects downward.

SUMMARY OF THE INVENTION

An object of the present invention is to carry out a matte satination operation with the aid of a calender with the roll-specific pressures being adjustable, i.e., without the roll-specific pressures having to be fixed.

This object may be attained by a calender having a roll stack that has two end rolls and at least one intermediary roll. The end rolls each have a deflection compensation device that acts in a direction toward the intermediary roll. At least one end roll has an additional compensation device acting in a direction away from the intermediary roll and a supplementary deflection compensation roll disposed on a side of the at least one end roll which is remote from the intermediary roll.

Thus, this object may be attained by a calender having a roll stack. The calender includes at least one intermediary roll. The calender also includes two end rolls which each have a deflection compensation device that acts in a direction toward the intermediary roll, wherein at least one end roll has an additional deflection compensation device acting in a direction away from the intermediary roll. The calender further includes a supplementary roll disposed on a side of the at least one end roll which is remote from the intermediary roll.

Therefore, in comparison with conventional calenders, an additional roll suited for matte satination operation is added to the calender. In the present invention, the supplementary roll has a construction similar to end rolls used in conventional calenders. Therefore, practically no additional space is required, with the exception of a slight increase in the height of the new calender. Also, the additional cost stays within limits because no additional floor space is required. The additional expense involves providing a second deflection compensation device to an end roll and providing an additional deflection compensation roll. In other words, in comparison with conventional supercalenders, the end roll embodied as a deflection adjusting roll is shifted over by one position and a bi-directionally acting deflection adjusting roller is added. The additional expenditure is acceptable since the new calender can carry out the matte satination operation practically and allows adjustment of the pressures that are determined by the roll or rolls.

In the present invention, pressures can be adjusted within wide ranges. Operation can take place with relatively low pressures because the deflection compensation devices of the end roll and the supplementary roll can cooperate and can assure that the nip remains straight. If one seeks to operate at a pressure that goes beyond the pressures necessary for the compensation of the individual deflection, then the deflection compensation devices of both the end roll and the supplementary roll, which devices work in opposition to each other, cooperate. If one seeks to operate at a lower pressure, then the deflection compensation device of the end roll is used, which device acts in the direction of the intermediary roll or rolls. Thus, if only the compensation device of the end roll is used, a pressure release of the nip in the direction of the supplementary roll occurs.

In a preferred embodiment, the supplementary roll and the associated end roll have a common bearing device on the machine frame. The machine frame can, for example, be the seating of the calender or the calender stanchion. This embodiment permits the operational behavior of the calender to otherwise only be changed in a nonessential manner. In particular, with the installation of the supplementary roll in the region of the bottom roll, this embodiment even has advantages because the bottom roll is provided with additional weight which accelerates the lowering of the bottom roll when the rolls of the calender must be separated.

Preferably, at least one of the rolls on the common bearing device can be shifted in relation to the other roll of the common bearing device. By means of this shifting, the nip between the two rolls can be opened so that the supplementary roll is actually used only when the matte satination operation is carried out.

In preferred embodiments, the supplementary roll has a carrier that is supported on the bearing device via a hydraulic cylinder. This embodiment has two advantages. First, the end roll is disposed to rotate at a fixed location on the bearing device so that in controlling the rolls, practically no changes have to be made in relation to a conventional calender. Second, the supplementary roll can be moved as a unit, i.e., not just its jacket. As a result, the construction is simple.

Preferably at least one of the supplementary roll and the end roll has a separate rotary drive. Thus, the matte satination operation can then be carried out without external drives.

In preferred embodiments, the rotary drive is disposed on the bearing device and is connected to the roll disposed to rotate at fixed a location on the bearing device. A rigid connection between the rotary drive and the roll can then be provided because the positions of the roll and the rotary drive do not change in relation to each other.

Advantageously, the bearing device is disposed so that it can be moved on the machine frame. This disposition is particularly advantageous when the supplementary roll is provided in the region of the bottom roll. When the matte satination operation is carried out, the end roll can be separated from the intermediary rolls so that the wear and tear of the intermediary rolls remains low.

It is also preferable that either the supplementary roll or the end roll has a soft surface and the other roll has a hard surface. Then, with the aid of the supplementary roll, a soft calender can be formed, which has proven its worth both intrinsically and for matte satination.

Further embodiments and advantages can be seen from the detailed description of the present invention and the accompanying figures.

BRIEF DESCRIPTION OF THE DRAWINGS

The present invention is further described in the detailed description which follows, in reference to the noted drawings by way of non-limiting examples of preferred embodiments of the present invention, wherein same reference numerals represent similar parts throughout the several views of the drawings.

DETAILED DESCRIPTION

Figure 1:
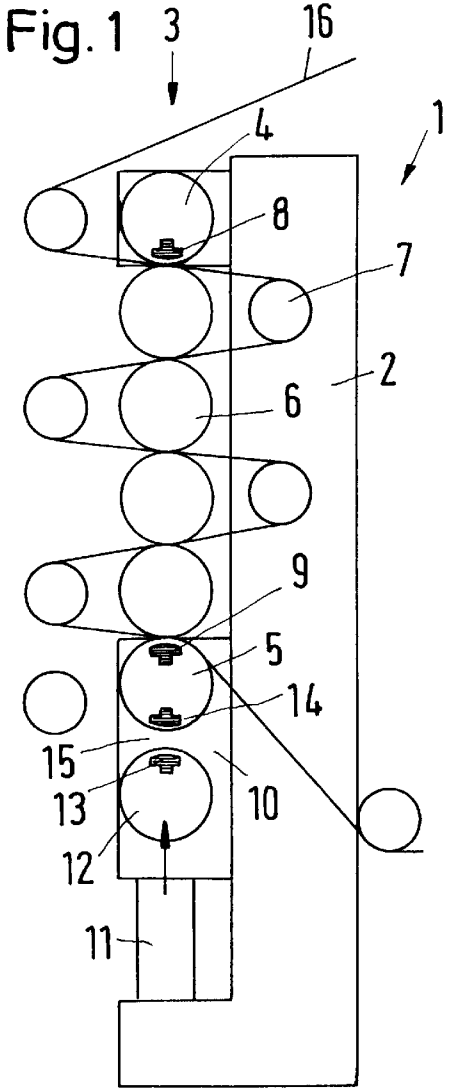
FIG. 1 shows a calender in normal operation.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

A calender 1 has a frame 2 in which a roll stack 3 is disposed. The roll stack has a top roll 4, a bottom roll 5, and a number of intermediary rolls 6. A number of guide rolls 7 are provided for web guidance. The top roll 4 and the bottom roll 5 are both also referred to as end rolls.

The top roll 4 and the bottom roll 5 are embodied as deflection compensation rolls. They each have deflection compensation devices 8 and 9, that act in the direction of the intermediary rolls 6.

The intermediary rolls 6 and the bottom roll 5 can be moved in relation to the frame 2. The top roll 4 is affixed to the frame. For this purpose, the intermediary rolls are fastened to the frame 2 via bearings, not shown. The bottom roll 5 is disposed in a bearing device 10, which can be moved upward with the aid of a hydraulic cylinder 11. As soon as all the nips between the intermediary rolls 6 and the bottom roll 5 or the top roll 4 are closed, the hydraulic cylinder 11 can also be used to increase the pressure in the nips. A deflection of the rolls 4, 5, 6 is compensated for by the deflection compensation devices 8, 9.

Furthermore, a supplementary roll 12 is disposed on the bearing device 10, is likewise embodied as a deflection compensation roll, and correspondingly has a deflection compensation device 13. This deflection compensation device 13 acts in the direction of the bottom roll 5.

The bottom roll 5 additionally has a second deflection compensation device 14, which acts in the direction of the supplementary roll 12.

All of the deflection compensation devices 8, 9, 13, 14 can be embodied, for example, by hydrostatically acting sliding shoes, which are supported on a carrier, not shown, which passes axially through the rolls 4, 5, 12.

The supplementary roll 12 can be moved in the vertical direction on the bearing device 10. It can therefore be moved in relation to the bottom roll 5. In the position shown in FIG. 1, the supplementary roll 12 permits a nip 15 to open in the direction of the bottom roll 5. The bearing device 10, though, has been moved so far in the direction of the top roll 4 that all of the other nips are closed. The paper web 16 to be treated can then be calendered in the normal operation.

Figure 2:
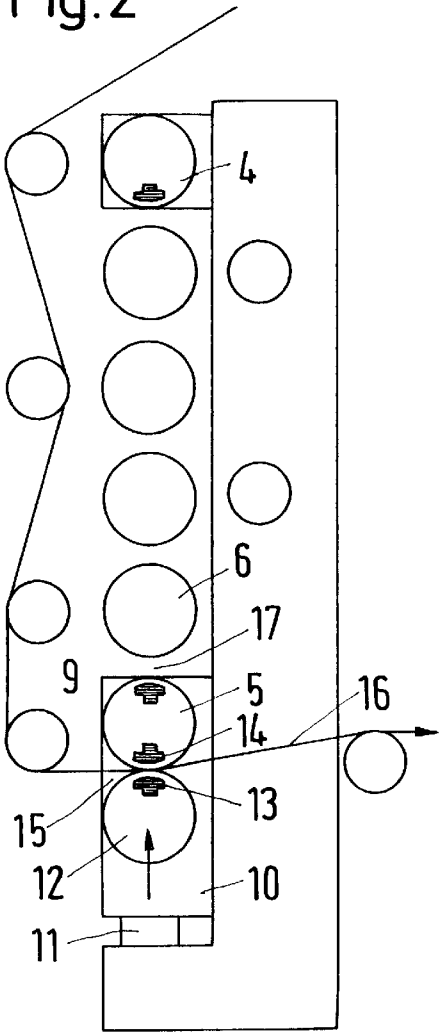
FIG. 2 shows the calender in matte satination.

FIG. 2 now shows another mode of operation in which all the nips are open, in particular a nip 17 between the bottom roll 5 and the subsequent intermediary roll 6. For this purpose, the nip 15 is closed, i.e., the supplementary roll 12 rests against the bottom roll 5 with the interposition of the paper web 16. In this case, the hydraulic cylinder 11 can be retracted. As will be explained in connection with FIGS. 4 and 5, a separate hydraulic cylinder is provided on the bearing device 10, which cylinder is used for shifting the supplementary roll 12 on the bearing device.

In the mode of operation shown in FIG. 2, the paper web 16 is guided only through the nip to matte satinate the paper web 16. For this purpose, either the bottom roll 5 or the supplementary roll 12 is provided with a soft surface while the other roll has a hard surface.

The pressures that prevail in the nip 15 can now be arbitrarily set within wide limits.

On the one hand, as was previously also possible, a pressure can be set that compensates for the individual deflection of the bottom roll 5. In this instance, only the deflection compensation devices 13 of the supplementary roll 12 are actuated. If the production of a higher pressure is desired, then both the deflection compensation device 13 and the deflection compensation device 14 are placed in operation. Besides the function of straightening the nip, they have the function of producing the necessary pressures.

However, if the production of lower pressures is desired, then the deflection compensation device 13 and the deflection compensation device 9 are placed in operation. The deflection compensation device 9 prevents the bottom roll 5 from deflecting downward when the supplementary roll 12 no longer exerts the necessary counter pressure.

Figure 3:
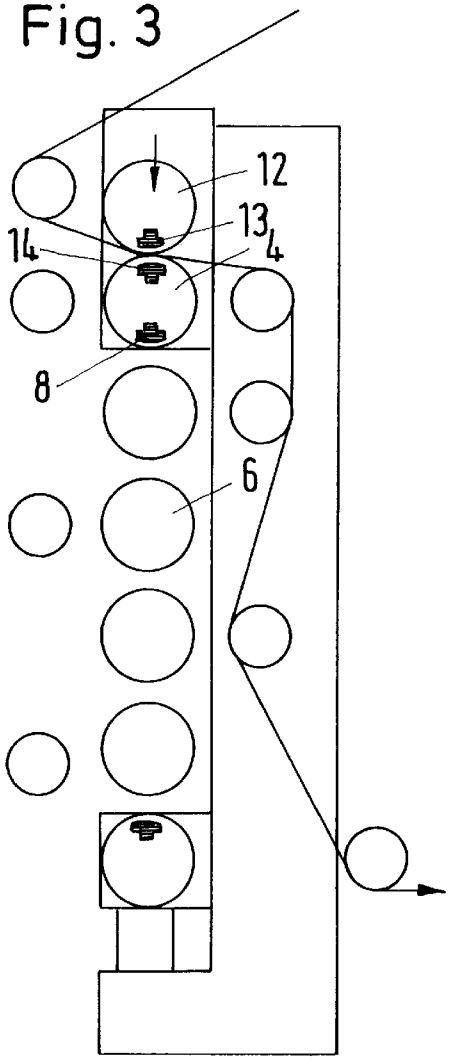
FIG. 3 shows a modified form of the calender with the supplementary roll in the top position.

FIG. 3 shows the possibility of allowing the supplementary roll 12 to also cooperate with the top roll 4. In this instance, the top roll 2 has deflection compensation devices 8 and 14, wherein compensation device 14 acts in the direction away from the intermediary rolls 6, but this time in an upward direction. In the same manner, the deflection compensation device 13 of the supplementary roll 12 acts in a downward direction, i.e., in the direction toward the intermediary rolls 6.

Figure 5:
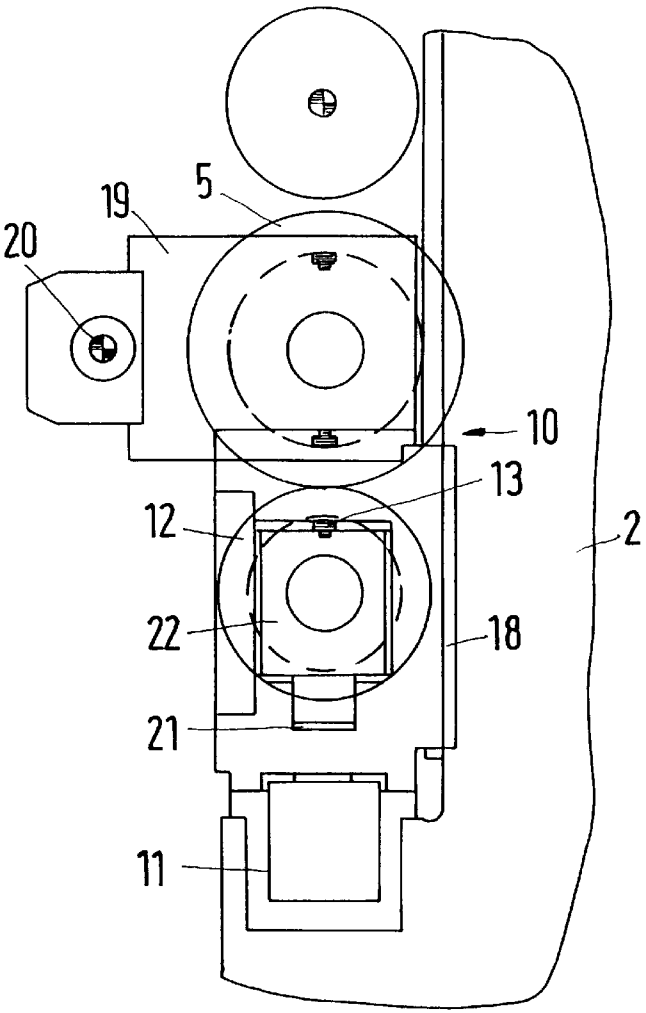
FIG. 5 shows the detail of the calender in the mode of operation according to FIG. 2.
Figure 4:
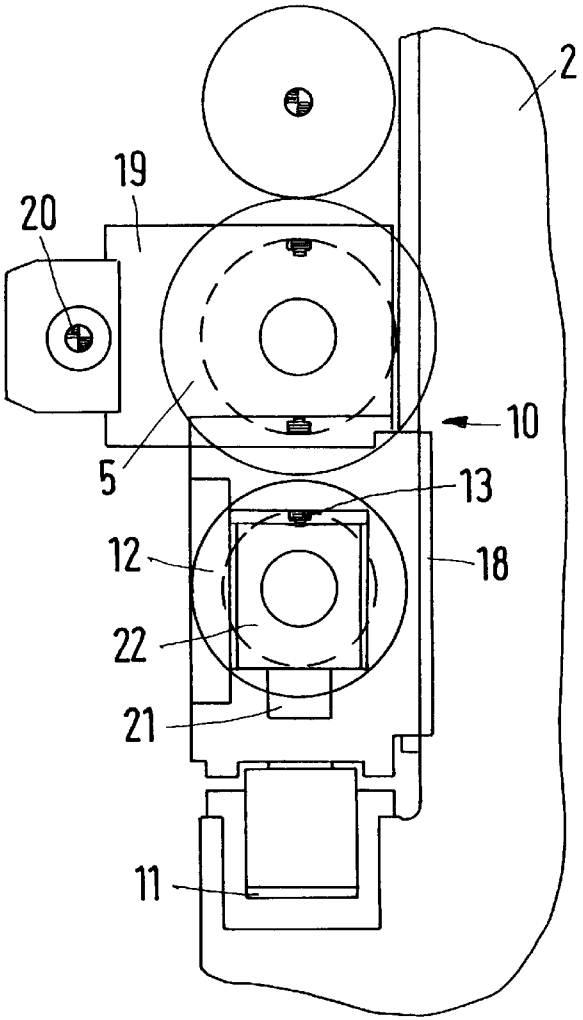
FIG. 4 shows a detail of the lower end of the calender in the mode of operation according to FIG. 1.

FIGS. 4 and 5 show the bearing device 10 with the bottom roll 5 and the supplementary roll 12 in more detail.

The bearing device 10 includes a slide 18, which is disposed so that it can move vertically on the frame 2. The slide 18 is driven by hydraulic cylinder 11, which is shown under pressure in FIG. 4 and is shown discharged in FIG. 5.

A roll carrier 19 is disposed on the slide 18 in a stationary manner. The roll carrier 19 carries the bottom roll 5. The roll carrier 19 also has a roll rotating drive 20 that is rigidly connected to the bottom roll 5.

Another hydraulic cylinder 21 is provided on the slide 18, which cylinder is shown discharged in FIG. 4 and is shown under pressure in FIG. 5. A roll carrier 22 is disposed on the piston of this hydraulic cylinder, which roll carrier passes axially through the supplementary roll 12. The elements of the deflection compensation device 13 are supported on the roll carrier. The nip 15 between the bottom roll 5 and the supplementary roll 12 can be opened or closed by using the hydraulic cylinder 21.

The hydraulic cylinder 21 can be smaller than the hydraulic cylinder 11 since it only has to shift the supplementary roll 12 in relation to the bottom roll 5. The hydraulic cylinder 11, though, must be able to lift the bottom roll 5 and all of the intermediary rolls 6.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and the spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A calender having a roll stack that has two end rolls and at least one intermediary roll, wherein the end rolls each have a deflection compensation device that acts in a direction toward the intermediary roll, comprising:

at least one end roll having an additional compensation device acting in a direction away from the intermediary roll; and a supplementary deflection compensation roll disposed on a side of at least one end roll which is remote from the intermediary roll;

wherein the supplementary deflection compensation roll and at least one end roll are disposed on a common bearing device which is disposed on a machine frame.

2. The calender of claim 1, wherein one member of the group consisting of the supplementary deflection compensation roll and the at least one end roll has a soft surface and the other member has a hard surface.

3. The calender of claim 1, wherein the common bearing device comprises a slide which allows the bearing device to move on the machine frame.

4. The calender of claim 1, wherein a hydraulic cylinder is connected to the common bearing device and the machine frame, and wherein the hydraulic cylinder is capable of moving the common bearing device relative to the machine frame.

5. The calender of claim 1, wherein the common bearing device comprises a means for shifting one member selected from the group consisting of the supplementary deflection compensation roll and the at least one end roll in relation to the other member.

6. The calender of claim 1, wherein the common bearing device comprises a mover capable of shifting one member selected from the group consisting of the supplementary deflection compensation roll and the at least one end roll in relation to the other member.

7. The calender of claim 6, wherein the supplementary deflection compensation roll has a roll carrier that is supported on the bearing device via a hydraulic cylinder.

8. The calender of claim 1, wherein at least one member selected from the group consisting of the supplementary deflection compensation roll and the end rolls has a separate rotary drive.

9. The calender of claim 8, wherein the rotary drive is disposed on the bearing device and is connected to a roll which is disposed on the bearing device such that the roll rotates in a fixed location with respect to the bearing device.

10. The calender of claim 1, wherein one of the supplementary deflection compensation roll and at least one end roll has a soft surface and the other has a hard surface.

11. A calender having a roll stack comprising:

at least one intermediary roll;

two end rolls which each have a deflection compensation device that acts in a direction toward the intermediary roll, and wherein at least one end roll has an additional deflection compensation device acting in a direction away from the intermediary roll; and a supplementary roll disposed on a side of at least one end roll which is remote from the intermediary roll; and wherein the supplementary roll and the at least one end roll are disposed on a common bearing device which is disposed on a machine frame.

12. The calender of claim 11, wherein the supplementary roll comprises a deflection compensation roll.

13. The calender of claim 11, wherein one member of the group consisting of the supplementary roll and the at least one end roll has a soft surface and the other member has a hard surface.

14. The calender of claim 11, wherein the common bearing device comprises a slide which allows the bearing device to move on the machine frame.

15. The calender of claim 11, wherein the common bearing device comprises a means for shifting one member selected from the group consisting of the supplementary roll and the at least one end roll in relation to the other member.

16. The calender of claim 11, wherein the common bearing device comprises a mover capable of shifting one member selected from the group consisting of the supplementary roll and the at least one end roll in relation to the other member.

17. The calender of claim 16, wherein the supplementary roll has a roll carrier that is supported on the bearing device via a hydraulic cylinder.

18. The calender of claim 11, wherein at least one member selected from the group consisting of the supplementary roll and the end rolls has a separate rotary drive.

19. The calender of claim 18, wherein the rotary drive is disposed on the bearing device and is connected to a roll which is disposed on the bearing device such that the roll rotates in a fixed location with respect to the bearing device.

20. The calender of claim 11, wherein the supplementary roll comprises a deflection compensation roll.

21. The calender of claim 11, wherein one of the supplementary roll and the at least one end roll has a soft surface and the other has a hard surface.

* * * * *